US005281329A

United States Patent [19]

Mueller et al.

[11] Patent Number: 5,281,329

[45] Date of Patent: Jan. 25, 1994

[54] METHOD FOR IMPROVING THE POUR POINT OF PETROLEUM OILS

[75] Inventors: Michael Mueller, Bensheim; Heinz Gruenig, Pfungstadt, both of Fed. Rep. of Germany

[73] Assignee: Röhm GmbH, Darmstadt, Fed. Rep. of Germany

[21] Appl. No.: 860,109

[22] Filed: Mar. 30, 1992

Related U.S. Application Data

[63] Continuation of Ser. No. 696,304, Apr. 29, 1991, abandoned, which is a continuation of Ser. No. 552,816, Jul. 16, 1990, abandoned.

[30] Foreign Application Priority Data

Jul. 14, 1989 [DE] Fed. Rep. of Germany ..... 3923249

[51] Int. Cl.[5] ..... C10G 73/04

[52] U.S. Cl. ..... 208/370; 208/14; 137/13

[58] Field of Search ..... 137/13; 208/370; 44/397

[56] References Cited

U.S. PATENT DOCUMENTS

| | | | |
|---|---|---|---|
| 2,604,453 | 7/1952 | Popkin | 44/62 |
| 2,888,340 | 5/1959 | Winnick | 44/62 |
| 3,192,165 | 6/1965 | Fields et al. | 252/56 |
| 3,222,282 | 12/1965 | Berkowitz et al. | 44/62 |
| 3,252,949 | 5/1966 | Fields et al. | 44/62 |
| 3,275,427 | 9/1966 | Brownawell et al. | 44/62 |
| 3,304,260 | 2/1967 | Fields et al. | 252/51.5 |
| 3,660,057 | 5/1972 | Ilnyckyj | 44/62 |
| 3,661,541 | 5/1972 | Hollyday, Jr. | 44/62 |
| 3,772,182 | 1/1973 | Hubbard | 44/62 |
| 3,776,247 | 12/1973 | Choufoer et al. | 137/13 |
| 3,790,359 | 2/1974 | Feldman | 44/62 |
| 3,817,866 | 6/1974 | Yamamoto | 44/62 |
| 3,864,099 | 2/1975 | Ek | 44/62 |
| 3,904,385 | 9/1975 | Sweeney | 44/62 |
| 4,175,926 | 11/1979 | Wisotsky | 44/62 |
| 4,872,885 | 10/1989 | Tsubakimo et al. | 44/62 |
| 4,886,520 | 12/1989 | Le | 44/62 |
| 4,911,736 | 3/1990 | Huang et al. | 44/62 |
| 4,954,135 | 9/1990 | Le | 44/62 |
| 4,983,186 | 1/1991 | Naimann et al. | 137/13 |
| 5,039,432 | 8/1991 | Ritter et al. | 137/13 |

FOREIGN PATENT DOCUMENTS

| | | | |
|---|---|---|---|
| 1037891 | 9/1978 | Canada | 196/69 |
| 0344644 | 6/1989 | European Pat. Off. | C10L 1/18 |
| 1770695 | 11/1971 | Fed. Rep. of Germany . | |
| 0573364 | 11/1945 | United Kingdom . | |
| 1154966 | 6/1969 | United Kingdom | C10L 11/26 |

OTHER PUBLICATIONS

Proceedings of the Seventh World Petroleum Congress, vol. VII, "Applications and New Uses", Part 2, p. 95, Abstract 1967.

High Polymers, Gordon, Iliffe Books Ltd., London, pp. 102–103, Crystal (1963).

Comprehensive Polymer Science, Allen and Bevington, vol. 3, Pergamon Press, p. 11 (1989).

*Primary Examiner*—Helane Myers

[57] ABSTRACT

Crude oils, vacuum gas oils, and residual oils containing long chain polyalkyl (meth)acrylates as flow improvers, wherein the long chain polyalkyl (meth)acrylates are a mixture of (A) a polyalkyl (meth)acrylate P1 having an onset of crystallization at temperatures above 15° C. (measured as the cloud point of a 0.1 % solution in isooctane) and (B) a polyalkyl (meth)acrylate P2 having an onset of crystallization at temperatures at or below 15° C., with the proviso that there is a temperature difference of at least 5 Centigrade degrees between the onset of the crystallization of polyalkyl (meth)acrylates P1 and the onset of crystallization of polyalkyl (meth)acrylates P2.

6 Claims, No Drawings

METHOD FOR IMPROVING THE POUR POINT OF PETROLEUM OILS

This is a continuation application of application Ser. No. 07/696,304 filed Apr. 29, 1991 and now abandoned, which in turn is a continuation of application Ser. No. 07/552,816 filed Jul. 16, 1990 and now abandoned.

The present invention relates to petroleum oils, such as crude oils, and petroleum oil products, such as crude oil fractions, containing a mixture of defined polyalkyl acrylates and methacrylates of different kinds as flow improvers.

The behavior in the cold of petroleum oils and petroleum oil products is decisively influenced by the paraffins contained therein. The paraffins crystallize out on cooling. In this way, the ability of the oils to flow is lowered or entirely prevented. On heating, the paraffins generally go back into solution in the oil matrix.

Industry has developed polymeric flow improvers, for example the so-called "pour point depressants" which, even in concentrations between 0.05 and 1 percent by weight, effectively reduce the "pour point" (i.e. the temperature at which the oil just still flows, cf. DIN 51597). The effect of these materials has been explained with the following proposed model: Paraffin-like compounds are incorporated in the growing paraffin crystals and in this way hinder the further growth of the crystals and the formation of extended crystal agglomerates. (Cf. *Ullmanns Encyclopädie der technischen Chemie,* 4th edition, Vol. 20, p. 548, Verlag Chemie 1981).

Polymers comprising (meth)acrylic acid esters of long chain alkanols (C>12) are effective flow improvers for crude oils (cf. DE-A 17 70 695). Polybehenyl acrylate can be given as a prototype of a flow improver for crude oils. Polybehenyl acrylate itself crystallizes at a temperature of +20° C. (determined in 0.1 percent concentration in isooctane by a "cloud point" measurement according to DIN 51597 or ASTM D 97-66), and meets very well the assumptions of being of reciprocally acting with the long chain paraffins in the crude oil. To be sure, the high price of the starting materials stands in the way of the use of polybehenyl acrylate and comparable long chain polyacrylates.

Unpublished German patent application P 38 18 438 describes paraffin containing petroleum oils from the group of crude oils, vacuum gas oils, and residual oils having improved flow properties, wherein the petroleum oils have in common an onset of paraffin crystallization at a temperature<30° C. and a content of 1 to 10,000 ppm of at least one polymer selected from the class of polyalkyl (meth)acrylates or polydialkyl fumarates, the onset of crystallization of which is below 15° C.

Even with a knowledge of the basic teachings of the state of the art, according to which long chain alkyl esters, particularly $C_{18-24}$ - alkyl esters of (meth)acrylic acid can improve the low temperature flow behavior of crude oils, it was not possible to recognize any technical rule which could contribute to an optimization of the flow improving effect of polyalkyl (meth)acrylates.

Even ignoring this, the relatively high costs of the aforementioned flow improvers of the state of the art amounted to a demand to search for more advantageously priced compositions having—if possible—the same or improved properties.

The temperature dependent onset of paraffin crystallization in oils can be taken as a significant criterion for the determination of the flow improving effect. (For the method of determination, cf. A. Ecker in "Erdöl und Kohle", 38(6), 281 (1985); A. Ecker, Erdöl, Erdgas 101, 154 (1982); R. L Baline, NGLI-Spokesman, June 1976.

The paraffins contained in the oils crystallize on cooling with the liberation of heat. The liberated heat can be detected by means of differential thermal analysis (DTA) or, preferably, differential scanning calorimetry (DSC) as an exothermic peak. In this way, the onset of paraffin crystallization can be determined without error, whereas the determination of the "wax appearance point" or of the "cloud point", which are based on visual observation, can fail in dark products and in residues.

It has now been found that certain mixtures of polyalkyl (meth)acrylates meet the requirements of industry to a particular degree. This is all the more unexpected because one of these polyalkyl (meth)acrylate components per se must be considered ineffective or at least as rather poorly effective. Thus, a synergistic effect is present. The present invention accordingly pertains to petroleum oils and petroleum oil products which are crude oils, vacuum gas oils, or residual oils having improved flow behavior containing long chain polyalkyl (meth)acrylates, wherein the long chain polyalkyl (meth)acrylates are a mixture of (A) a polyalkyl (meth)acrylate, P1, having on onset of crystallization at temperatures above 15° C. (measured as the cloud point according to DIN 51597 as a 0.1 solution in isooctane) and (B) a polyalkyl (meth)acrylate, P2, having an onset of crystallization or segregation at temperatures equal to or below 15° C., with the proviso that there is a temperature difference of at least 5° C., preferably 10° C., between the onset of crystallization of the polyalkyl (meth)acrylates P1 and the onset of crystallization or segregation of the polyalkyl (meth)acrylates P2.

The two polymer components P1 and P2 are preferably in a weight relationship of 1:50 to 50:1, particularly 1:10 to 10:1.

As is known in the art, a tendency for crystallization (side chain crystallization) arises in the polyacrylate esters and polymethacrylate esters of long chain alcohols, in contrast to the esters of lower alcohols, the position of the melting point being influenced by the number of carbon atoms or by the length of the side chains and by their number and distribution in the homo- or co- polymer.

The polyalkyl (meth)acrylates P1 of the type (A) having an association temperature above 15° C. are, as a rule, formed from monomers having an alkyl portion>C 18, or contain determinative amounts thereof. In particular, the polyalkyl (meth)acrylates of $C_{18-26}$ - alkanols, especially of $C_{18-24}$ - alkanols, are suitable, particularly polybehenyl acrylate (Polymer P1-a).

The polyalkyl (meth)acrylates P2 of type (B) required according to the invention having an association temperature (onset of crystallization)<15° C. are represented by esters of acrylic or methacrylic acid, particularly with longer chain alkanols (from C1, preferably from C8, and up to C40), thus including those having $C_{16-24}$ - alkyl groups, but wherein the choice is so made that the aforementioned criterion of the association temperature (<15° C.) is met. Use can be made in this connection of the following selection criteria:

Polymerization or copolymerization of esters of acrylic acid with having alkyl groups<18 C-atoms, particularly 12–18 C-atoms;

polymerization or copolymerization of esters of methacrylic acid, instead of acrylic acid, particularly having $C_{12-40}$-alkyl groups;

copolymerization with monomers which are not capable of side chain crystallization, particularly those having alkyl groups<C10 or branched alkyl groups having C1 to C40.

For example, the following polymer types meet the aforementioned requirements:

polytallow fatty acrylates ($C_{16-18}$ - alkyl acrylates)=P2-a, polybehenyl methacrylate ($C_{18-24}$ - alkyl methacrylates)=P2-b, copolymers of behenyl acrylate ($C_{18-24}$ - alkyl acrylates), and isodecyl acrylate=P2-c.

The molecular weights of the polymers P1 or P2 in general lie in the region from 5000 to 1,000,000, preferably 10,000 to 500,000. In general the maintenance of the molecular weight range is assured by the use of chain transfer agents known per se, for example the sulfur chain transfer agents. (Cf. H. Rauch-Puntigam, Th. Völker, *Acryl- und Methacrylverbindungen, Springer-Verlag, Berlin* 1967). Mercaptans such as dodecyl mercaptan, in amounts from 0.01 to 2 percent by weight calculated on the monomers, are specially mentioned. The determination of the molecular weight is by means of gel permeation chromatography with polymethyl methacrylate as the standard (cf. Kirk-Othmer, *Encyclopedia of Chemical Technology,* 3rd edition, Vol 18, pages 209, 749, J. Wiley 1982).

The monomeric starting materials are known per se or can be obtained in a known fashion, for example by transesterification with higher alcohols of lower (meth-)acrylates such as the methyl or ethyl ester. The preparation of the polymers can be carried out relying on the free radical polymerization method of the state of the art. (Cf. H. Rauch-Puntigam, Th. Völker, *Acrylund Methacrylverbindungen,* Springer-Verlag, Berlin 1967). As the polymerization medium, an inert medium is recommended, preferably of the petroleum oil type itself, for example 100 N-oil (viscosity at 100° C.=4 $mm^2/s$).

The reaction vessels commonly used are employed, suitably equipped with a stirrer, heating arrangement, thermometer, reflux condenser, and inlet for dosing reagents. Preferably one works under an inert gas such as carbon dioxide. Further, use is made of the usual free radical initiators, preferably peresters, peroxides, or azo compounds, for example tert.-butyl perbenzoate and tert. butyl perpivalate, in the usual concentrations, for example 0.1-5, preferably 0.3 to 1, percent by weight calculated on the total amount of the monomers. In general, polymerization is begun at an elevated temperature, preferably from 60° C., particularly from 70° C. to 90° C., whereupon initiator is added and the temperature reaches a peak which can be above 80° C., for example 140°±10° C. Post polymerization can by induced by optional renewed addition of initiator and, if necessary, by warming. In general, the polymerization is concluded within about 5 hours.

The petroleum oils and petroleum oil fractions whose properties, in particular whose temperature dependent flow behavior, can be improved by the present invention, are predominately petroleum oil products from the following groups:

crude oils;

vacuum gas oils having a boiling point from 320° C. to 500° C. at normal pressure (true boiling point); and residual oils (distillation residues which would distill above 350° C.). (Cf. Winnacker-Küchler, *Chemische Technologie,* Volume 5, 4th edition, Carl Hanser Verlag, Munich 1981).

The onset of paraffin crystallization (CP) in dependence on temperature is an important characteristic value for the provenance of petroleum oil or for the petroleum oil products in question, the determination of which is routinely performed by the skilled artisan. The preferred method of determination is—as already mentioned—DSC.

In general, the content of combined polymers P1 and P2 in petroleum oils whose flow properties they serve to improve is 1-10,000 ppm, preferably 50 to 2000 ppm, depending on their origin.

The polymers can, after successful polymerization, advantageously be diluted with a suitable compatible solvent, for example a hydrocarbon such as xylene, toluene, kerosene, or the solvent commercially available as "SHELLSOL". The solution so obtained can then be used for the preparation of the petroleum oil mixtures. In a special case, this solution can be directly dosed into crude oil at the well head or in the pipeline.

The polymers P1 and P2, preferably in the form of the aforementioned solutions, are suitably added to the crude oils, vacuum gas oils, or residual oils at elevated temperature, for example at 40° C. to about 80° C. The effect of the flow improving additive persists for the period of time normally required. In addition to the polymers P1 and P2 according to the invention, no further supplemental flow improvers are required, but still other components such as demulsifiers, can be added.

The outstanding flow improving effect of mixtures of (A) and (B) was all the less predictable since the polymers P2 with their characteristic association temperatures below 15° C. are per se ineffective or at least badly effective as flow improvers. In the combination, an efficacy is obtained—based on the amount of the polymer added—which is better than or equal to that of polymer component P1 alone. In every case, an unambiguous synergistic effect is observed. Even in the case of an efficacy which is not superior but only equal, there are significant advantages—because of better availability or lower price.

A petroleum oil model can be developed for the unexpected mutual action of the two polymer components P1 and P2, the soundness of which model, however, should have no influence on the foregoing technical teachings: In a first phase, the component with the higher characteristic association temperature influences the crystallization of the long chain crude oil paraffins. In a second "low temperature phase", the second component with the lower characteristic association temperature becomes effective. From this model, certain selection criteria for preferred combinations can be derived, which, however, are to be understood as rough rules of thumb since there are exceptions and overlaps.

With polybehenyl acrylate as component (A), one can proceed from the following starting point. In crude oils in which polybehenyl acrylate reduces the pour point at most to 0° C., components (B) having characteristic crystallization temperatures between 0° C. and 15° C. are advantageous. In crude oils in which the pour point can be reduced to below −5° C. with polybehenyl acrylate, components (B) having characteristic association temperatures <−5° C. are optimal.

A better understanding of the present invention and of its many advantages will be had from the following specific examples, given by way of illustration.

EXAMPLE 1—PREPARATION OF POLYBEHENYL ACRYLATE P1-a 51 kg of behenyl acrylate ($C_{18-24}$ - acrylate), 9 kg of 100 N-oil, and 0.051 kg of dodecyl mercaptan were introduced into a 100 liter stirred kettle, degassed with dry ice, and warmed to 70° C. Then, 0.191 kg of t-butyl perpivalate and 0.115 kg of t-butyl perbenzoate were added in order to start the polymerization. 1 hour after reaching the temperature peak of 134° C., 0.077 kg of dodecyl mercaptan and 0.051 kg of t-butyl perbenzoate were added and the batch was post polymerized for 3 hours at 130° C.

Mw (GPC, PMMA - standard)=560,000 g/mol
$\eta_{sp}$/C ($CHCl_3$, 20° C.)=48 ml/g
CP (0.1 percent in isooctane)=19.5° C.

Instead of behenyl acrylate, materials such as "ALFOL 20" (acrylic esters of C20-, C22-, and C24 - alcohols) can be employed, for example.

EXAMPLE 2—PREPARATION OF POLYBEHENYL METHACRYLATE P2-b 30 kg of behenyl methacrylate ($C_{18-24}$ - methacrylate), 30 kg of 100 N-oil, and 0.60 kg of dodecyl mercaptan were introduced into a 100 liter stirred kettle. After degassing of the mixture with dry ice, it was warmed to 70° C. and 0.60 kg of t-butyl perpivalate were added. 2 hours after reaching a temperature peak of 96.5° C., the mixture was warmed to 130° C. and 0.03 kg of dodecyl mercaptan and 0.06 kg of t-butyl perbenzoate were added. After 5 hours the polymerization was concluded.

Mw (GPC, PMMA standard)=24,300 g/mol
$\eta_{sp}$/C ($CHCl_3$, 20° C.)=11 ml/g
CP (0.1 percent in isooctane)=−2° C.

EXAMPLE 3—PREPARATION OF POLYTALLOW FATTY ACID ACRYLATE P2-a 102 kg of tallow fatty acid ($C_{16-18}$-acrylate), 18 kg of 100 N-oil, and 2.55 kg of dodecyl mercaptan were introduced into a 200 liter vessel. The mixture was degassed by the addition of dry ice and then warmed to 70° C. Then 0.612 kg of t-butyl perpivalate were added. The temperature rose to 142° C. One hour, and again 2 hours, after reaching the temperature peak, 0.204 kg of dodecyl mercaptan and 0.102 kg of t-butyl perbenzoate were added at 130° C. After 5 hours, the polymerization was concluded.

Mw (GPC, PMMA standard)=20,100 g/mol
$\eta_{sp}$/C ($CHCl_3$, 20° C.)=9.3 ml/g
CP (0.1 percent in isooctane)=9.5° C.

EXAMPLE 4—PREPARATION OF POLYTALLOW FATTY ACRYLATE ACID P2-a'

85 kg of tallow fatty acid acrylate ($C_{16-18}$ - acrylate), 15 kg of 100 N-oil, and 0.425 kg of dodecyl mercaptan were introduced into a 150 liter kettle. The mixture was degassed by the addition of dry ice and then warmed to 70° C. Then 0.425 kg of t-butyl perpivalate were added. The temperature rose to 148° C. One hour, and again 2 hours, after reaching the temperature peak, 0.17 kg of dodecyl mercaptan and 0.085 kg of t-butyl perbenzoate were added at 130° C. After 5 hours the polymerization was concluded.

Mw (GPC, PMMA standard)=118,000 g/mol
$\eta_{sp}$/C ($CHCl_3$, 20° C.)=21 ml/g
CP (0.1 percent in isooctane)=+10° C.

EXAMPLE 5—PREPARATION OF A COPOLYMER OF BEHENYL METHACRYLATE AND METHYL METHACRYLATE P2-c 67.1 kg of behenyl methacrylate ($C_{18-24}$ - methacrylate), 7.9 kg of methyl methacrylate, 75 kg of 100 N-oil, and 1.875 kg of dodecyl mercaptan were introduced into a 200 liter stirred kettle. The mixture was degassed by the addition of $CO_2$ ice and warmed to 70° C. Then, 0.3 kg of t-butyl perpivalate were added, whereupon the temperature rose to 94° C. 5 hours after the beginning of the reaction, 0.075 kg of dodecyl mercaptan and 0.15 kg of t-butyl perpivalate were added. After a further 6 hours at 70° C., the polymerization was concluded.

Mw (GPC, PMMA-standard)=26,000 g/mol
$\eta_{sp}$/C ($CHCl_3$, 20° C.) 11 ml/g
CP (0.1 percent in isooctane)=−7° C.

EXAMPLE 6—PREPARATION OF POLY($C_{16-18}$ - ALKYLMETHACRYLATE) P2-d 4.889 kg of $C_{16-18}$- alkyl methacrylate (e.g. comprising "ALFOL 1618S", an alcohol product of Condea), 44.0 kg of 100 N-oil, and 0.172 kg of t-butyl peroctoate were introduced into a 150 liter stirred kettle. After degassing with dry ice, the batch was warmed to 85° C. Then 51.111 kg of $C_{16-18}$- alkyl methacrylate and 0.153 kg of t-butyl peroctoate were added over a period of 3.5 hours using a dosage pump. 2 hours after addition was complete, a further 0.112 kg of t-butyl peroctoate was added. After a further 5 hours, the polymerization was completed.

Mw (GPC, PMMA-standard)=220,000 g/mol
$\eta_{sp}$/C ($CHCl_3$, 20° C.)=44 ml/g
CP (0.1 percent in isooctane)=−14 ° C.

EXAMPLE 7—PREPARATION OF POLY($C_{12-18}$ - alkyl methacrylate) P2-e 2.967 kg of a $C_{12-18}$ - alkyl methacrylate (average C 14, 18 percent branched, e.g. comprising a mixture of "DOBANOL 25L" of Shell and tallow fatty acid alcohol), 26.7 kg of 100 N-oil, and 0.083 kg of t-butyl peroctoate were introduced into a 150 liter stirred kettle, degassed with dry ice, and heated to 85° C. Over a period of 3.5 hours, 37.033 kg of $C_{12-18}$- alkyl methacrylate and 0.0741 kg of t-butyl peroctoate were added. 2 hours after conclusion of this addition, 0.08 kg of t-butyl peroctoate were added. After a further 5 hours the batch was diluted with 33.3 kg of 100 N-oil.

Mw (GPC, PMMA-standard)=410,000 g/mol
$\eta_{sp}$/C ($CHCl_3$, 20° C.)=65 ml/g
CP (0.1 percent in isooctane)=<−45° C.

EXAMPLES 8-12

Polymers P1-a - P2-e were added as 10 percent solutions in xylene to crude oils at 80° C. All additions are calculated on the polymer. The pour points were determined following DIN 51597 using an automatic measuring apparatus of the firm Herzog, Lauda. The pour points in Example 8 were determined according to DIN 51597 (ASTM 097-66).

The Examples verify the better efficacy of the mixtures as compared with the individual components.

EXAMPLE 8

Indian crude oil, 23.4 percent n-alkane content, pour point without additive=30° C.

| Flow Improver = Polymer | | 75 ppm | 150 ppm |
|---|---|---|---|
| P1-a | | +15 | +12 |
| P2-b | | +30 | +30 |
| P3 | | +30 | +27 |
| P1-A:P2-b | = 1:1 | +12 | +9 |
| P1-a:P2-a | = 2:1 | | +9 |
| | = 1:1 | +12 | +6 |
| | = 1:2 | | +9 |
| | = 1:3 | | +9 |

EXAMPLE 9

Baltic crude oil, 8.6 percent n-alkane content, pour point without additive=12° C.

| Flow Improver = Polymer | | 4 ppm | 8 ppm | 16 ppm | 30 ppm |
|---|---|---|---|---|---|
| P1-a | | +10 | +5 | +2 | −15 |
| P2-d | | | | | +10 |
| P1-a:P2-d | = 1:1 | | −8 | | |
| | 1:4 | −7 | −8 | −16 | |
| | 1:9 | +3 | ±0 | −2 | |

EXAMPLE 10

North Sea crude oil, 10.2 percent alkane content, pour point without additive=+6° C.

| Flow Improver = Polymer | | 10 ppm | 20 ppm | 500 ppm |
|---|---|---|---|---|
| P1-a | | −15 | −19 | |
| P2-c | | | +3 | |
| P2-d | | | +6 | +6 |
| P2-e | | | +6 | |
| P1-a:P2-c | = 1:1 | −20 | −22 | |
| P1-a:P2-d | = 1:1 | −16 | −24 | |
| | = 1:4 | | −14 | |
| P1-a:P2-e | = 1:1 | | −14 | |
| | = 1:4 | | −8 | |

EXAMPLE 11

Pakistani crude oil, 23.6 percent alkane content, pour point=+19° C.

| Flow Improver = Polymer | | 250 ppm | 500 ppm | 1000 ppm |
|---|---|---|---|---|
| P1-a | | | | −7 |
| P2-a' | | −3 | −11 | −14 |
| P1-a:P2-a' | = 1:1 | −3 | −11 | −18 |
| | = 1:4 | −7 | −13 | −18 |
| | = 1:9 | −9 | −18 | −18 |

EXAMPLE 12

Pakistani crude oil, 23 percent n-alkane content, pour point=+9° C.

| Flow Improver = Polymer | | 100 ppm |
|---|---|---|
| P1-a | | −2 |
| P2-a' | | +3 |
| P1-a:P2-a' | = 1:1 | −5 |
| | = 1:4 | −3 |
| | = 1:9 | −2 |

EXAMPLE 13

North German vacuum gas oil, 2.2 percent n-alkane content, pour point=21° C.

| Flow Improver = Polymer | | 1000 ppm |
|---|---|---|
| P1-a | | +2 |
| P2-a | | −2 |
| P1-a:P2-a | = 1:1 | −3 |
| | = 1:4 | −4 |
| | = 1:6 | −5 |

What is claimed is:

1. The method of improving the pour point of a petroleum product selected from the group consisting of crude oils, vacuum gas oils, and residual oils which comprises adding to said petroleum product from 0.001 to 1 percent, by weight of said oils, of a pour point improver which is a mixture of (A) a polymer selected from the group consisting of polyalkyl acrylates and polyalkyl methacrylates having an onset of crystallization at a temperature above 15° C. and (B) a polymer selected from the group consisting of polyalkyl acrylates and polyalkyl methacrylates having an onset of crystallization at a temperature of 15° C. or below, said polymers (A) and (B) each being prepared by free radical polymerization initiated at a temperature above 60° C. and being so selected that there is a temperature difference of at least 5 Centigrade degrees between the onset of the crystallization of polyalkyl (meth)acrylates (A) and the onset of crystallization of polyalkyl (meth)acrylates (B), measured as the cloud point of a 0.1 percent solution in isooctane.

2. A method as in claim 1 wherein said product comprises said pour point improver in an amount from 0.005 to 0.2 percent by weight of said oils.

3. A method as in claim 1 wherein the ratio by weight of said polyalkyl (meth)acrylates (A) to said polyalkyl (meth)acrylates (B) is from 1:50 to 50:1.

4. A method as in claim 1 wherein the ratio by weight of said polyalkyl (meth)acrylates (A) to said polyalkyl (meth)acrylates (B) is from 1:10 to 10:1.

5. A method as in claim 1 wherein said polyalkyl (meth)acrylates (A) are polyacrylic acid esters of $C_{18-24}$ - alkanols.

6. A method as in claim 1 wherein polymers (A) and (B) are each prepared by free radical polymerization initiated at a temperature above 70° C.

* * * * *